US005108882A

United States Patent [19]

Parton et al.

[11] Patent Number: 5,108,882

[45] Date of Patent: Apr. 28, 1992

[54] INFRARED-SENSITIVE PHOTOGRAPHIC ELEMENT CONTAINING AT LEAST TWO PHOTOSENSITIVE LAYERS

[75] Inventors: Richard L. Parton, Webster; Annabel A. Muenter; Anthony Adin, both of Rochester, all of N.Y.

[73] Assignee: Eastman Kodak Company, Rochester, N.Y.

[21] Appl. No.: 412,746

[22] Filed: Sep. 26, 1989

[51] Int. Cl.[5] ..... G03C 1/46

[52] U.S. Cl. ..... 430/502; 430/503; 430/506; 430/508; 430/576; 430/584; 430/594; 430/944

[58] Field of Search ..... 430/944, 576, 584, 502, 430/503, 506, 508, 594, 591, 593

[56] References Cited

U.S. PATENT DOCUMENTS

| | | | |
|---|---|---|---|
| 3,582,344 | 6/1971 | Heseltine et al. | 96/106 |
| 3,694,216 | 9/1972 | Jenkins | 96/128 |
| 4,619,892 | 10/1986 | Simpson et al. | 430/505 |
| 4,801,525 | 1/1989 | Mihara et al. | 430/518 |

OTHER PUBLICATIONS

Chemical Abstracts vol. 101: 181246g "Photothermographic Material", JP 58,145,936, Aug. 31, 1983.

*Primary Examiner*—Marion E. McCamish
*Assistant Examiner*—J. Dote
*Attorney, Agent, or Firm*—Andrew J. Anderson

[57] ABSTRACT

A photographic element is described comprising a support having thereon (a) a silver halide emulsion layer where the silver halide is sensitized with a dye having the formula:

wherein $Z_1$ and $Z_2$ each independently represents the atoms necessary to complete a substituted or unsubstituted 5- or 6-membered heterocyclic nucleus, $R_1$ and $R_2$ each independently represents substituted or unsubstituted alkyl or substituted or unsubstituted aryl, and $R_3$, $R_4$, $R_5$, and $R_6$ each independently represents hydrogen, substituted or unsubstituted alkyl, substituted or unsubstituted aryl, X represents a counterion, and (b) at least one other red- or infrared-sensitive silver halide emulsion layer having a maximum sensitivity at a wavelength different from that of the (a) layer.

19 Claims, No Drawings

INFRARED-SENSITIVE PHOTOGRAPHIC ELEMENT CONTAINING AT LEAST TWO PHOTOSENSITIVE LAYERS

FIELD OF THE INVENTION

This invention relates to photography and specifically to silver halide photographic elements sensitive to infrared radiation.

BACKGROUND OF THE INVENTION

Silver halide photography usually involves the exposure of silver halide with light in order to form a latent image that is developed during photographic processing to form a visible image. Silver halide is intrinsically sensitive only to light in the blue region of the spectrum. Thus, when silver halide is to be exposed to other wavelengths of radiation, such as green or red light in a multicolor element or infrared radiation in an infrared-sensitive element, a spectral sensitizing dye is required. Sensitizing dyes are chromophoric compounds (usually cyanine dye compounds) that are adsorbed to the silver halide. They absorb light or radiation of a particular wavelength and transfer the energy to the silver halide to form the latent image, thus effectively rendering the silver halide sensitive to radiation of a wavelength other than the blue intrinsic sensitivity.

The advent of solid state diodes that emit an infrared laser beam has expanded the useful applications of infrared-sensitive photographic elements. These include making prints from computer assisted tomography scanners, various graphic arts products that are exposed by diode lasers, and infrared-sensitive false color-sensitized photographic materials as described in U.S. Pat. No. 4,619,892 of Simpson et al.

False color infrared-sensitive photographic elements generally have a first layer that is sensitive to infrared radiation and one other layer that is sensitive to red or infrared radiation. This other layer has a maximum sensitivity at a wavelength different from the first infrared-sensitive layer. One problem encountered by such photographic elements is poor image separation between the different layers. This is due to unwanted sensitivity of one layer to radiation that is intended to expose the other layer(s) caused by overlap of spectral sensitization ranges of the sensitizing dyes.

The above-referenced U.S. Pat. No. 4,619,892 describes infrared sensitizing dyes such as:

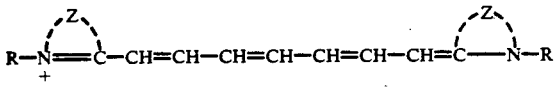

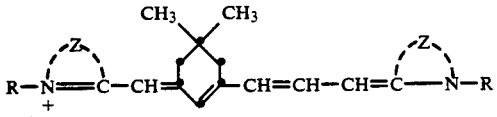

where Z is a heterocycle of the type useful in cyanine dyes (e.g., benzothiazole) and R is alkyl. The '892 patent address the problem of image separation with a number of well-known techniques, such as speed differences between the various silver halide emulsion layers, filters layers between the silver halide emulsion layers, or combinations thereof. Such techniques, however, are limited in the amount of improvement in image separation that is provided, due to the inherent overlap in the wavelengths of spectral sensitization imparted by the dyes.

SUMMARY OF THE INVENTION

It has now been found that infrared-sensitive photographic elements having an infrared-sensitive layer and another infrared- or red-sensitive layer can be provided with improved image separation between the layers by providing the element with:

(a) an infrared-sensitive silver halide emulsion layer spectrally sensitized by a dye having the formula:

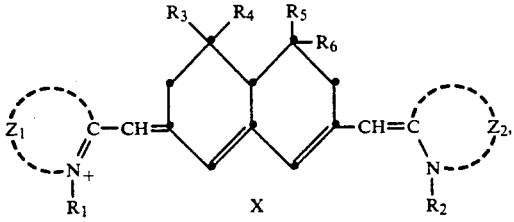

wherein $Z_1$ and $Z_2$ each independently represents the atoms necessary to complete a substituted or unsubstituted 5- or 6-membered heterocyclic nucleus, $R_1$ and $R_2$ each independently represents substituted or unsubstituted alkyl or substituted or unsubstituted aryl, and $R_3$, $R_4$, $R_5$, and $R_6$ each independently represents hydrogen, substituted or unsubstituted alkyl, substituted or unsubstituted aryl, X represents a counterion, and (b) at least one other red- or infrared-sensitive silver halide emulsion layer having a maximum sensitivity at a wavelength different from that of the (a) layer.

The photographic element of the invention has good image separation between the layers. If the element is exposed with monochromatic radiation sources (e.g., lasers such as solid state infrared-emitting laser diodes) at or near the wavelength of maximum sensitivity for each layer, less image contamination (i.e., exposure of one layer by the exposure source emitting at the wavelength of maximum sensitivity of another layer) is seen as compared to previous false color infrared-sensitive elements.

DESCRIPTION OF THE PREFERRED EMBODIMENTS

According to formula (I), $Z_1$ and $Z_2$ each independently represents the atoms necessary to complete a substituted or unsubstituted 5- or 6-membered heterocyclic nucleus. This nucleus is preferably a substituted or unsubstituted: thiazole nucleus, oxazole nucleus, selenazole nucleus, quinoline nucleus, tellurazole nucleus, pyridine nucleus, or thiazoline nucleus. This nucleus may be substituted with known substituents, such as halogen (e.g., chloro, fluoro, bromo), alkoxy (e.g., methoxy, ethoxy), alkyl, aryl, aralkyl, sulfonate, and others known in the art. Especially preferred are substituted or unsubstituted thiazole or oxazole nuclei.

Examples of useful preferred nuclei for $Z_1$ and $Z_2$ include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl)thiazole, benzothiazole, 4-chlorobenzothiazole, 5-chlorobenzothiazole, 6-chlorobenzothiazole, 7-chlorobenzothiazole, 4-methyl-benzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole, 6-hydroxybenzothiazole, naphtho[2,1-d]thiazole, naptho[1,2-d]thiazole, 5-methoxynaphtho[2,3-d]thiazole, 5-ethoxynaphtho[2,3-d]thiazole, 8-methoxynaphtho[2,3-d]thiazole, 7-methoxy-naphtho[2,3-d]thiazole, 4'-methoxythianaphtheno-7',6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole 5-ethoxybenzoxazole, 5-chlorobenzoxazole, 6-methoxybenzoxazole, 5-hydroxybenzoxazole, 6-hydroxybenzoxazole,naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1,2-d]tellurazole 5,6-dimethoxytellurazole, 5-methoxytellurazole, 5-methyltellurazole; a thiazoline nucleus, e.g., thiazoline, 4-methylthiazoline, etc.

$R_1$ and $R_2$ may be substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., β-hydroxyethyl, ω-hydroxybutyl, etc., an alkoxyalkyl group, e.g., β-methoxyethyl, ω-butoxybutyl, etc., a carboxyalkyl group, e.g., β-carboxyethyl, ω-carboxybutyl, etc.; a sulfoalkyl group, e.g., β-sulfoethyl, ω-sulfobutyl, etc., a sulfatoalkyl group, e.g., β-sulfatoethyl, ω-sulfaztobutyl, etc., an acyloxyalkyl group, e.g., β-acetoxyethyl, λ-acetoxypropyl, ω-butyryloxbutyl, etc., an alkoxycarbonylalkyl group, e.g., β-methoxycarbonylethyl, ω-ethoxycarbonylbutyl, etc., or an aralkyl group, e.g., benzyl, phenethyl, etc., or, any aryl group, e.g., phenyl, tolyl, naphthyl, methoxyphenyl, chlorophenyl, etc.; alkyl group may be substituted by one or more of these substituents.

$R_3$, $R_4$, $R_5$, and $R_6$ each independently represents hydrogen, substituted or unsubstituted alkyl, substituted or unsubstituted aryl, and are preferably hydrogen or methyl. Examples of aryl groups useful as $R_3$ and $R_4$ include phenyl, tolyl, methoxyphenyl, chlorophenyl, and the like. Examples of unsubstituted alkyl groups useful as $R_3$–$R_6$ include the unsubstituted alkyls described above for $R_1$ and $R_2$. Examples of substituents for alkyl groups are known in the art, e.g., alkoxy and halogen.

X represents a counterion as necessary to balance the charge of the dye molecule. The counterion may be ionically complexed to the molecule or it may be part of the dye molecule itself to form an intramolecular salt. Such counterions are well-known in the art. For example, when X is an anion (e.g., when $R_1$ and $R_2$ are unsubstituted alkyl), examples of X include chloride, bromide, iodide, p-toluene sulfonate, methane sulfonate, methyl sulfate, ethyl sulfate, perchlorate, and the like. When X is a cation (e.g., when $R_1$ and $R_2$ are both sulfoalkyl or carboxyalkyl), examples of X include sodium, potassium, triethylammonium, and the like.

Examples of dyes according to formula (I) are set forth below. Many of these dyes, in addition to offering the above-described advantages of narrow sensitization deep in the infrared, can also exhibit good safelight performance in that they have low sensitivity to green light.

TABLE I

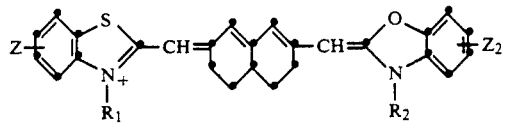

| Dye | $Z_1$ | $Z_2$ | $R_1$ | $R_2$ |
|---|---|---|---|---|
| 1 | H | H | Et | Me |
| 2 | H | 4,5-Benzo | Et | Et |
| 3 | H | 4,5-Benzo | Et | $-(CH_2)_3SO_3^-$ |
| 4 | H | 5,6-Me | Et | Et |
| 5 | 6-Me | 5,6-Me | Et | Et |
| 6 | 5-OMe | 5,6-Me | Et | Et |
| 7 | 4,5-Benzo | 5,6-Me | Et | Et |

TABLE II

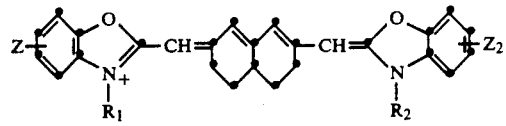

| Dye | $Z_1$ | $Z_2$ | $R_1$ | $R_2$ |
|---|---|---|---|---|
| 8 | H | H | Et | Et |
| 9 | 5-6-Benzo | 5-6-Benzo | Et | Et |

TABLE III
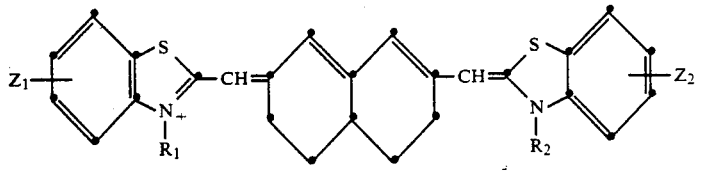
| Dye | $Z_1$ | $Z_2$ | $R_1$ | $R_2$ |
|---|---|---|---|---|
| 10 | —H | —H | Et | Et |
| 11 | 5-SMe | 5-SMe | Me | Me |
| 12 | 5-OMe | 5-OMe | Et | Et |
| 13 | 5,6-SMe | 5,6-SMe | Et | Et |
| 14 | 4,5-Benzo | 4,5-Benzo | Et | Et |
15
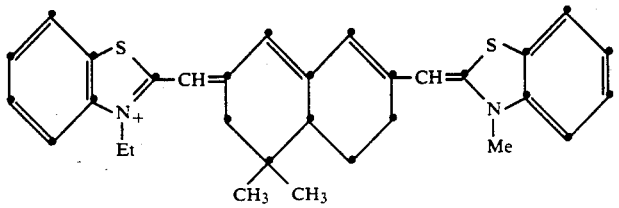
16
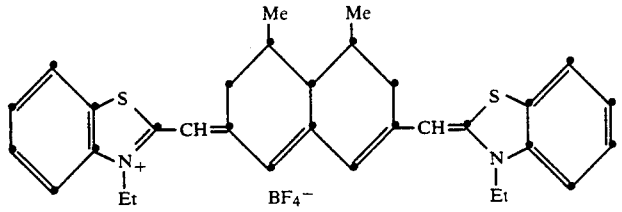
17
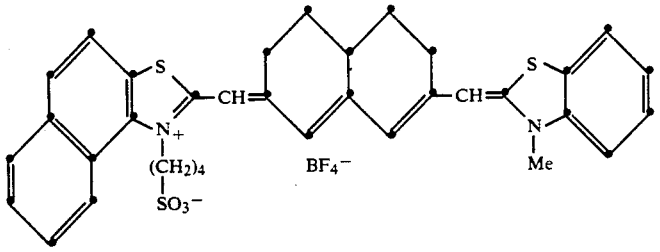
18
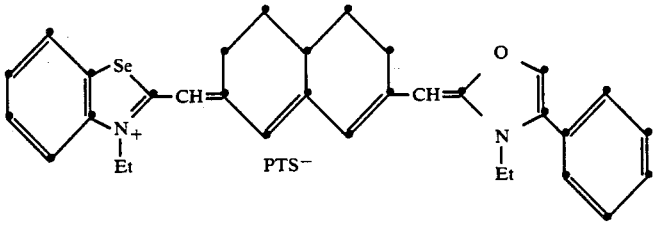
19
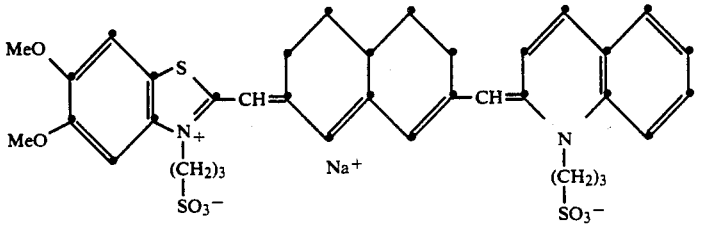

TABLE III-continued

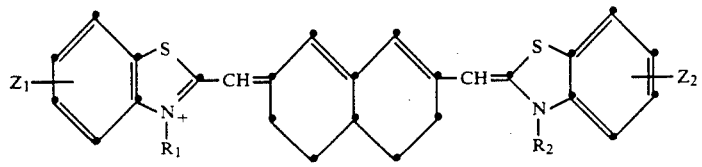

| Dye | $Z_1$ | $Z_2$ | $R_1$ | $R_2$ |
|---|---|---|---|---|
| 20 | | | | |
| 21 | | | | |
| 22 | | | | |

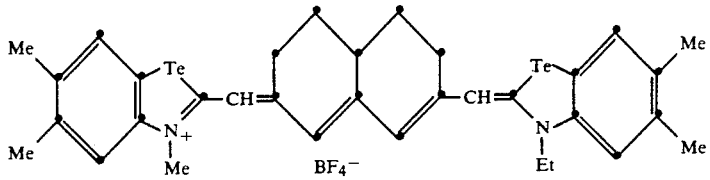

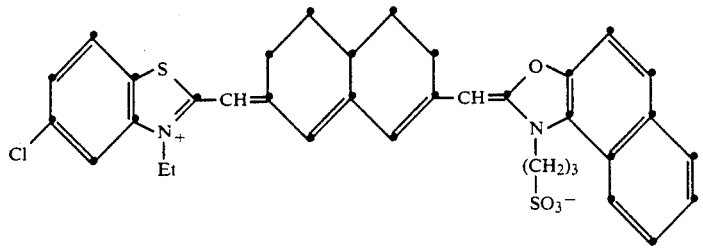

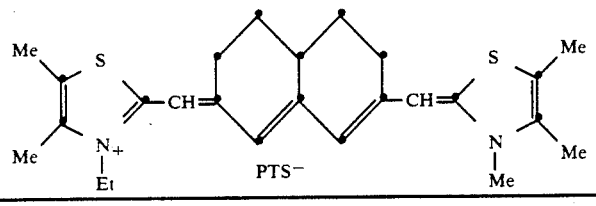

Tricarbocyanine dyes and their methods of synthesis are well-known in the art. Synthetic techniques for known tricarbocyanine dyes, such as set forth by Hamer, Cyanine Dyes and Related Compounds, John Wiley & Sons, 1964, apply equally as well to the dyes of formula (I). Synthesis of the dyes of formula (I) is also described in U.S. Pat. No. 3,582,344 and A. I. Tolmachev et al, Dokl. Akad. Nauk SSSR, 177, 869-872 (1967), the disclosures of which are incorporated herein by reference.

The dyes of formula (I) are advantageously used to sensitize photographic silver halide emulsions to infrared radiation. These silver halide emulsions can contain grains of any of the known silver halides, such as silver bromide, silver chloride, silver bromoiodide, and the like, or mixtures thereof, as described in *Research Disclosure*, Item 17643, Dec., 1978 [hereinafter referred to as *Research Disclosure I*], Section I. The silver halide grains may be of any known type, such as spherical, cubic, or tabular grains, as described in *Research Disclosure I*, Section I or *Research Disclosure*, Item 22534, Jan. 1983.

The above dyes can be used in a number of ways to provide good image separation in infrared-sensitive photographic materials. For example, in one preferred embodiment, the a) layer has its maximum sensitivity between about 790 nm and 850 nm, the (b) layer has its maximum sensitivity between about 730 nm and 790 nm, and at least one of $Z_1$ and $Z_2$ represents the atoms to complete a substituted or unsubstituted: thiazole nucleus, selenazole nucleus, quinoline nucleus, tellurazole nucleus, or pyridine nucleus. In another embodiment, the (a) layer has its maximum sensitivity between about 730 nm and 790 nm, the (b) layer has its maximum sensitivity between about 790 nm and 850 nm, and at least one of $Z_1$ and $Z_2$ represents the atoms to complete a substituted or unsubstituted: oxazole nucleus or thiazoline nucleus. In yet another such embodiment, the (a) layer has its maximum sensitivity between about 730 nm and 790 nm, the (b) layer has its maximum sensitivity between about 630 nm and 730 nm, and at least one of $Z_1$ and $Z_2$ represents the atoms to complete a substituted or unsubstituted: oxazole nucleus or thiazoline nucleus.

In a preferred embodiment of the invention, the (b) layer is an infrared-sensitive silver halide emulsion layer. This layer is preferably spectrally sensitized by a dye having the formula (II):

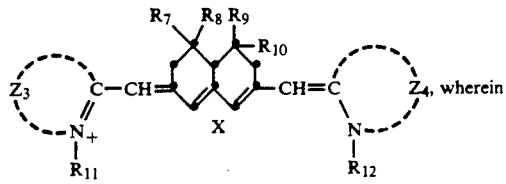

where $Z_3$ and $Z_4$ are defined the same as $Z_1$ and $Z_2$, $R_7$, $R_8$, $R_9$, and $R_{10}$ are defined the same as $R_3$, $R_4$, $R_5$, and $R_6$, and $R_{11}$ and $R_{12}$ are defined the same as $R_1$ and $R_2$.

In a preferred embodiment where the (a) layer is sensitized with a dye according to formula (I) and the (b) layer is sensitized with a dye according to formula (II), the (a) layer has its maximum sensitivity between about 730 nm and 790 nm, the (b) layer has its maximum sensitivity between about 790 nm and 850 nm, at least one of $Z_1$ and $Z_2$ represents the atoms necessary to complete a substituted or unsubstituted: oxazole nucleus or thiazoline nucleus, and at least one of $Z_3$ and $Z_4$ represents the atoms necessary to complete a substituted or unsubstituted: thiazole nucleus, selenazole nucleus, quinoline nucleus, tellurazole nucleus, or pyridine nucleus.

In some situations, it is preferable for any of the above-described elements to include (c) a third silver halide emulsion layer, which is an infrared-sensitive layer having a maximum sensitivity at a deeper wavelength than the (a) or (b) layers.

The silver halide emulsions generally include a hydrophilic vehicle for coating the emulsion as a layer of a photographic element. Useful vehicles include both naturally-occurring substances such as proteins, protein derivatives, cellulose derivatives (e.g., cellulose esters), gelatin (e.g., alkali-treated gelatin such as cattle bone or hide gelatin, or acid-treated gelatin such as pigskin gelatin), gelatin derivatives (e.g., acetylated gelatin, phthalated gelatin, and the like), and others described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount known to be useful in photographic emulsions.

In a preferred embodiment, the silver halide emulsion sensitized with a dye of formula (I) also contains a bis-azine compound. The bis-azines useful in the invention are well-known in the art (usually as supersensitizers for red- or infrared-sensitive silver halide emulsions). They include those according to the formula:

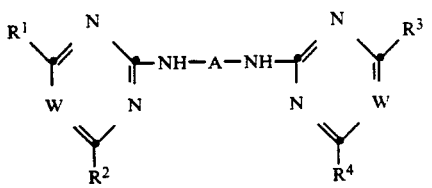

(III)

According to formula (III), W represents nitrogen or —$CR^5$= where $R^5$ is hydrogen, halogen (e.g., chloro, bromo, etc.), or alkyl (preferably of from 1 to 4 carbon atoms, e.g., methyl, ethyl, etc.). $R^1$, $R^2$, $R^3$, and $R^4$ each independently represents hydrogen, hydroxy, alkoxy (preferably having from 1 to 10 carbon atoms, e.g., methoxy, ethoxy, propoxy, etc.), alkyl (preferably having from 1 to 10 carbon atoms, e.g., methyl, ethyl, n-butyl, isopropyl, etc.), an aryloxy group (e.g., phenoxy, o-tolyloxy, p-sulfophenoxy, etc.), a halogen atom (e.g., chlorine, bromine, etc.), a heterocyclic nucleus (e.g., morpholinyl, piperidyl, etc.), an alkylthio group (wherein the alkyl moiety preferably has from 1 to 10 carbon atoms, e.g., methylthio, ethylthio, etc.), a heterocyclothio group (e.g., benzothiazolylthio, etc.), an arylthio group (e.g., phenylthio, tolylthio, etc.), an amino group, an alkylamino group, which term includes an unsubstituted and a substituted alkylamino group such as a hydroxy or sulfo-substituted alkylamino group (preferably an alkylamino group or substituted alkylamino group wherein the alkyl moiety has from 1 to 10 carbon atoms, e.g., methylamino, ethylamino, propylamino, dimethylamino, diethylamino, dodecylamino, cyclohexylamino, β-hydroxyethylamino, di-(β-hydroxyethyl)amino, β-sulfoethylamino, etc.), an arylamino group, which term includes an unsubstituted arylamino group and a substituted arylamino group, preferably a substituted arylamino group wherein the substituent is an alkyl group of from about 1 to 4 carbon atoms, a sulfo group, a carboxy group, a hydroxy group, and the like (e.g., anilino, o-sulfoanilino, m-sulfoanilino, p-sulfoanilino, o-anisylamino, m-anisylamino, p-anisylamino, o-toluidino, m-toluidino, p-toluidino, o-carboxyanilino, m-carboxyanilino, p-carboxyanilino, hydroxyanilino, disulfophenylamino, naphthylamino, sulfonaphthylamino, etc.), a heterocycloamino group (e.g., 2-benzothiazolylamino, 2-pyridyl-amino, etc.), an aryl group (e.g., phenyl, etc.), or a mercapto group, where $R^1$, $R^2$, $R^3$ and $R^4$ may each be the same as or different from one another.

Also according to formula (III), A represents a divalent aromatic residue, preferably comprising 1 to 4 aromatic rings. Such residues are known in the art and are described, for example, in U.S. Pat. Nos. 4,199,360, the disclosure of which is incorporated herein by reference. Examples of such divalent aromatic residues include:

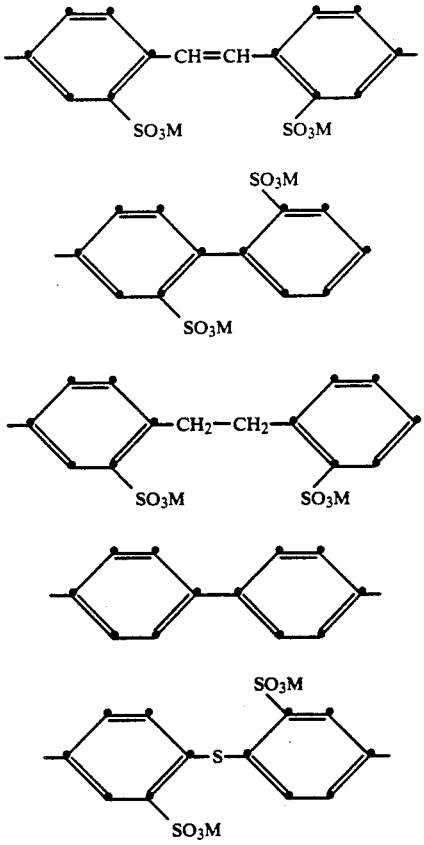

-continued
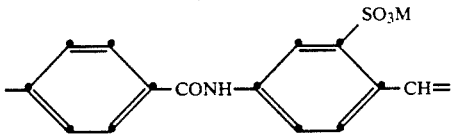
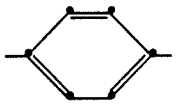
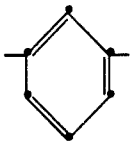
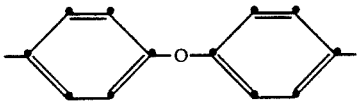
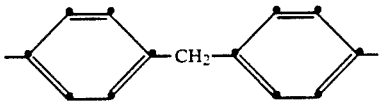
-continued
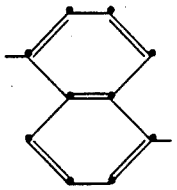
where M represents hydrogen or a cation (preferably an alkali metal, e.g., sodium, potassium, etc or an ammonium group).
In a preferred embodiment, the divalent aromatic residue represented by A is a stilbene. One such stilbene is represented by the formula:
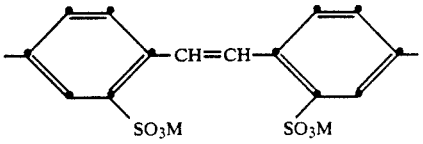
Specific examples of bis-azine compounds according to formula (III) include:
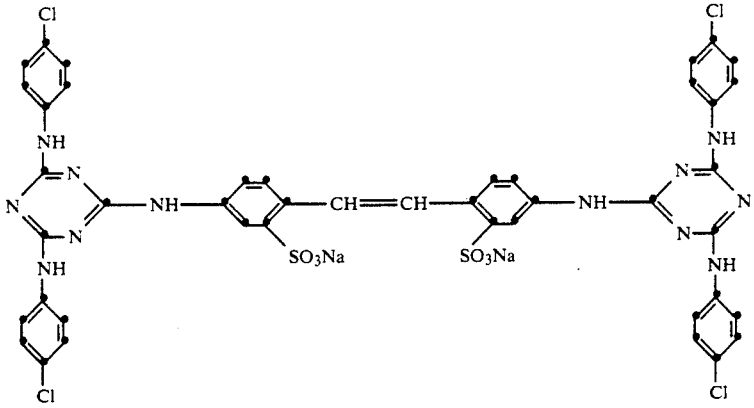
T-1
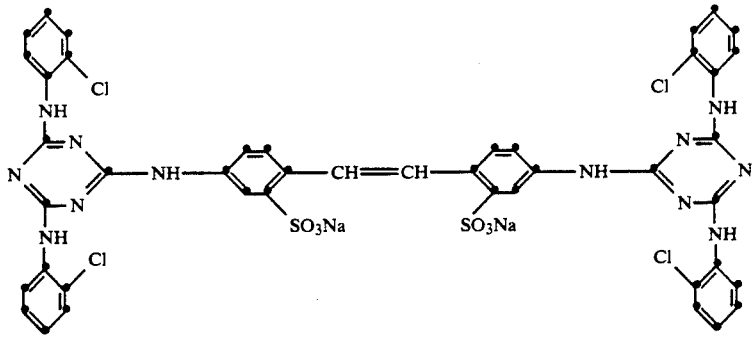
T-2
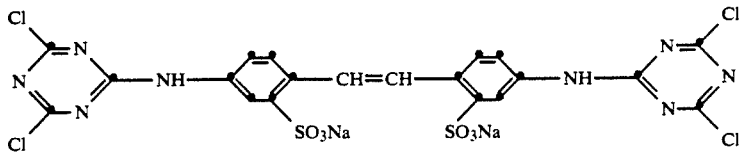
T-3

-continued

T-4

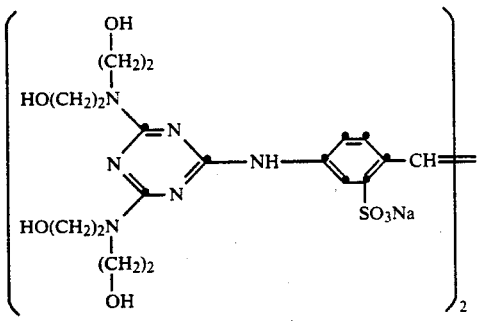

T-5

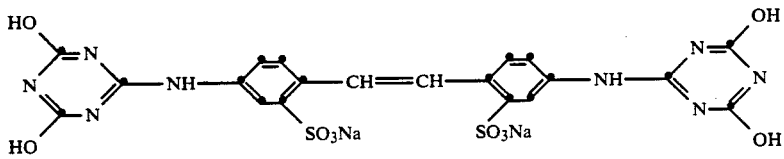

T-6

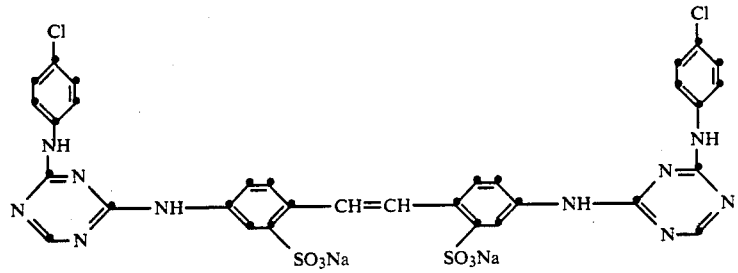

The optimum amount of the bis-azine compound will vary with factors such as the performance criteria of the photographic element, the processing conditions to be used, the type of emulsion, and the particular sensitizing dye. The bis-azine can be added to the emulsion melt or in other phases of silver halide emulsion preparation, such as during chemical sensitization. Useful amounts of the bis-azine compound preferably include from about 0.1 to about 100 moles/mole dye, although smaller amounts may also be useful depending on factors such as those identified above. Mixtures of different bis-azines can also be used.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in Research Disclosure, Jun. 1975, item 13452 and U.S. Pat. No. 3,772,031.

Other addenda include brighteners, antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor releasing couplers, and bleach accelerators. These addenda and methods of their inclusion in emulsion and other photographic layers are well-known in the art and are disclosed in *Research Disclosure I* and the references cited therein.

The emulsion layer containing silver halide sensitized with the dye of the invention can be coated simultaneously or sequentially with other emulsion layers, subbing layers, filter dye laters, or interlayers or overcoat layers, all of which may contain various addenda known to be included in photographic elements. These include antifoggants, oxidized developer scavengers, DIR couplers, antistatic agents, optical brighteners, light-absorbing or light-scattering pigments, and the like.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

The photographic element of the invention can be black and white or color. Since the photographic element of the invention is sensitive to infrared radiation, which is invisible to the human eye, a color element would be a false color sensitized element, with one or more infrared-sensitive layers having one or more dye-forming couplers associated therewith. Such an element is described, for example, in U.S. Pat. No. 4,619,892. Color dye-forming couplers and the various addenda associated therewith are well-known in the art and are described, for example, in *Research Disclosure I*, Section VII, and the references cited therein.

The invention is further described in the following example.

EXAMPLE 1

A multilayer color photographic element was prepared by coating, in order, the following layers on polyethylene coated paper support which had been previously overcoated with a layer containing 10.8 mg gelatin/dm$^2$:

Layer 1

A sulfur and gold sensitized silver chloride cubic emulsion (0.35 μm) was sensitized to the 750 nm region of the spectrum with Dye 9 at $3\times10^{-5}$ mole/mole Ag and coated at 3.4 mg Ag/dm$^2$. The emulsion also contained as addenda a triazinyl stilbene compound (structure T-2) at 500 mg/ mole Ag and 1-(3-acetamidophenyl)-5-mercapto-tetrazole sodium salt at 450 mg/mole Ag, and 1 mole percent potassium bromide. The layer contained 10.8 mg gelatin/dm$^2$ and 8.6 mg/dm$^2$ of yellow color-forming coupler (structure B).

Layer 2

A gelatin interlayer containing an oxidized developer scavenger was coated at 7.5 mg gelatin/dm$^2$.

Layer 3

The same emulsion used in layer 1 was sensitized to the 810 nm region of the spectrum with Dye 11 at $3\times10^{-5}$ mole/mole Ag and coated at 2.7 mg Ag/dm$^2$. In addition to the addenda used in layer 1, the emulsion contained 6-chloro-4-nitrobenzotriazole at 21 mg/mole Ag. The layer contained 10.8 mg gelatin/dm$^2$ and 4.3 mg/dm$^2$ of magenta color-forming coupler (structure C).

Layer 4

A gelatin interlayer containing an oxidized developer scavenger was coated at 7.5 mg gelatin/dm$^2$.

Layer 5

The same emulsion used in layer 1 was sensitized to the 870 nm region of the spectrum with a sensitizing dye represented below by structure D at $1.5\times10^{-5}$ mole/mole Ag and coated at 4.3 mg Ag/dm$^2$. The emulsion addenda were the same as for layer 3. The layer contained 10.8 mg gelatin/dm$^2$ and 4.3 mg/dm$^2$ of cyan color-forming coupler (Structure A).

Layer 6

A protective overcoat layer containing gelatin hardener was coated at 13.5 mg gelatin/dm$^2$.

Compound A

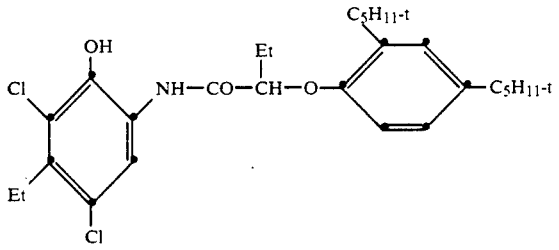

(Cyan coupler)

Compound B

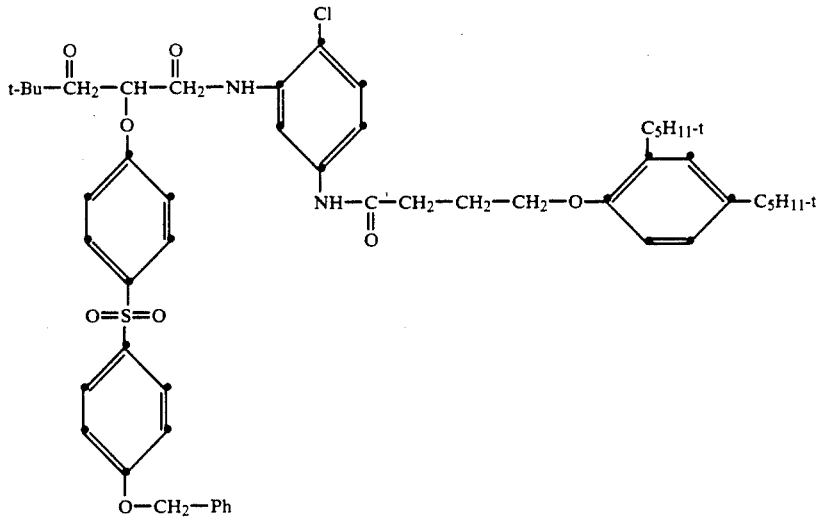

(Yellow coupler)

-continued

Compound C

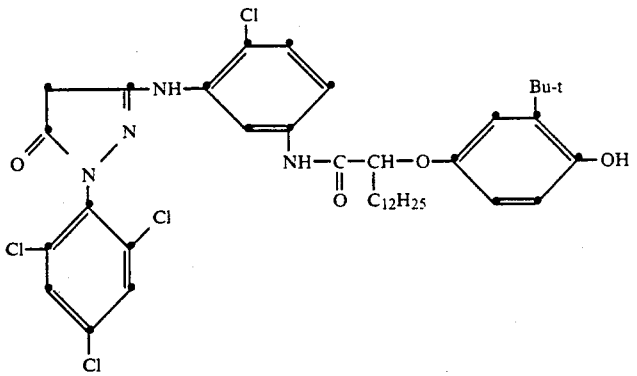

(Magenta coupler)

Compound D

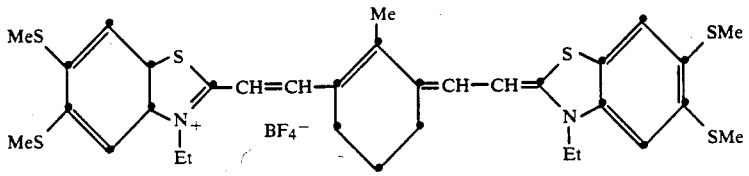

(870 nm sensitizing dye)

In order to evaluate the speed, curve shape, and image separation of the color multilayer, a laser diode sensitometer was employed that writes raster exposures onto the paper using a spinning polygon. Exposure modulation in 0.15 log E steps is provided by computer control of the current driving the diodes. The scan velocity across the paper is 274 m/sec. Exposures were made using 750, 810, and 870 nm diodes. The exposed multilayer was processed through a standard Kodak EP-2® process and speeds for each color record were measured at a Status A density of 1.0.

To further evaluate the image separation between different color records, a second laser diode sensitometer was also used. This sensitometer writes raster exposures using a galvanometer deflector and has a scan velocity of 3.39 m/s across the paper. This slower scan speed allows significantly larger total exposure values at the paper. Exposures of this type were made using 810 nm and 870 nm diodes. The exposed multilayer was processed through a standard Kodak EP-2® process and speeds for each color record measured at a Status A density of 1.0. Data from these exposures is included in Table IV. Image separation between layers is calculated by substracting the speeds obtained for the unwanted color images at a given wavelength from the speed obtained for the desired color image at that wavelength. The data in Table IV is compared to a comparison element described in Example 1 of Simpson et al U.S. Pat. No. 4,619,892. The image separation provided by the comparison element is calculated from the data in Table 1 of the '892 patent.

TABLE IV

| | Image Separation in 3 IR Wavelength Multilayer Laser Diode Exposures | | | |
|---|---|---|---|---|
| | Rel. Speed at Density = 1.0 | | Speed Separation | |
| | Invention | Comparison | Invention | Comparison |
| Yellow layer exposure: | | | | |
| Yellow | 3.27 | 3.58 | — | — |
| Magenta | 1.89 | 2.70 | yellow to magenta = 1.38 | yellow to magenta = 0.88 |
| Cyan | not measurable* | 2.01 | yellow to cyan > 2.0 (2.7 est.)* | yellow to cyan = 1.57 |
| Magenta layer exposure: | | | | |
| Yellow | ~0.80 | not measurable | magenta to yellow = ~1.7 | — |
| Magenta | 2.51 | 2.92 | — | — |
| Cyan | 1.13 | 2.26 | magenta to cyan = 1.38 | magenta to cyan = 0.66 |
| Cyan Layer exposure: | | | | |
| Yellow | not measurable | not measurable | cyan to yellow > 1.6 (2.5 est)* | — |
| Magenta | 0.43 | not measurable | cyan to magenta = 1.21 | — |
| Cyan | 1.64 | 2.77 | — | — |

*Separation estimated from interference filter exposures

The data in Table IV show that in the the yellow layer, the element of the invention has an image separation of 1.38 log E from the magenta layer and approximately 2.7 log E from the cyan layer. This is significantly greater than the image separation for the yellow layer of the comparison element, which was 0.88 log E from the magenta layer and 1.57 log E from the cyan layer. In the magenta layer, the element of the invention had an image separation of 1.38 log E from the cyan layer and 1.7 log E from the yellow layer The 1.38 magenta-cyan image separation for the element of the invention is significantly greater than the 0.66 log E magenta-cyan image separation for the magenta layer of the comparison element. There was insufficient exposure of the comparison element at the magenta wavelength to determine the speed separation from the yellow layer. The comparison element did not give sufficient exposure at the cyan wavelength to determine any speed separation values for this layer, so it is difficult to make any quantitative comparison for this case. However, after an evaluation of FIG. 1C of the '892 patent, it appears that the image separation for exposure of the cyan layer for the element of the invention is as good or better than the comparison element.

The invention has been described in detail with particular reference to preferred embodiments thereof, but it will be understood that variations and modifications can be effected within the spirit and scope of the invention.

What is claimed is:

1. A photographic element comprising a support having thereon:

(a) an infrared-sensitive silver halide emulsion layer spectrally sensitized by a dye having the formula:

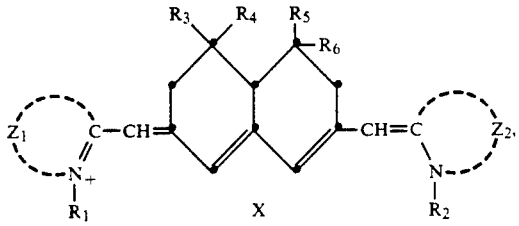

wherein $Z_1$ and $Z_2$ each independently represents the atoms necessary to complete a substituted or unsubstituted 5- or 6-membered heterocyclic nucleus, $R_1$ and $R_2$ each independently represents substituted or unsubstituted alkyl or substituted or unsubstituted aryl, and $R_3$, $R_4$, $R_5$, and $R_6$ each independently represents hydrogen, substituted or unsubstituted alkyl, substituted or unsubstituted aryl, X represents a counterion, and (b) at least one other red- or infrared-sensitive silver halide emulsion layer having a maximum sensitivity at a wavelength different from that of the (a) layer.

2. A photographic element according to claim 1 wherein $Z_1$ and $Z_2$ each independently represents the atoms necessary to complete a substituted or unsubstituted: thiazole nucleus, oxazole nucleus, selenazole nucleus, quinoline nucleus, tellurazole nucleus, pyridine nucleus, or thiazoline nucleus.

3. A photographic element according to claims 1 or 2 wherein the (b) layer is an infrared-sensitive silver halide emulsion layer.

4. A photographic element according to claim 3 wherein $R_3$, $R_4$, $R_5$, and $R_6$ are hydrogen or methyl.

5. A photographic element according to claim 3, further comprising (c) a third infrared-sensitive silver halide emulsion layer.

6. A photographic element according to claims 1 or 2 wherein $R_3$, $R_4$, $R_5$, and $R_6$ are hydrogen or methyl.

7. A photographic element according to claims 1 or 2 wherein the (a) layer has its maximum sensitivity between about 790 nm and 850 nm, the (b) layer has its maximum sensitivity between about 730 nm and 790 nm, and at least one of $Z_1$ and $Z_2$ represents the atoms necessary to complete a substituted or unsubstituted: thiazole nucleus, selenazole nucleus, quinoline nucleus, tellurazole nucleus, or pyridine nucleus.

8. A photographic element according to claim 7, further comprising (c) a third silver halide emulsion layer, which is an infrared-sensitive layer having a maximum sensitivity between about 850 nm and 900 nm.

9. A photographic element according to claims 1 or 2 wherein the (a) layer has its maximum sensitivity between about 730 nm and 790 nm, the (b) layer has its maximum sensitivity between about 790 nm and 850 nm, and at least one of $Z_1$ and $Z_2$ represents the atoms necessary to complete a substituted or unsubstituted: oxazole nucleus or thiazoline nucleus.

10. A photographic element according to claim 9, further comprising (c) a third silver halide emulsion layer, which is an infrared-sensitive layer having a maximum sensitivity between about 850 nm and 900 nm.

11. A photographic element according to claims 1 or 2 wherein the (a) layer has its maximum sensitivity between about 730 nm and 790 nm, the (b) layer has its maximum sensitivity between about 630 nm and 730 nm, and at least one of $Z_1$ and $Z_2$ represents the atoms necessary to complete a substituted or unsubstituted: oxazole nucleus or thiazoline nucleus.

12. A photographic element according to claim 11, further comprising (c) a third silver halide emulsion layer, which is an infrared-sensitive layer having a maximum sensitivity between about 790 nm and 900 nm.

13. A photographic element according to claims 1 or 2, further comprising (c) a third silver halide emulsion layer, which is an infrared-sensitive layer.

14. A photographic element according to claims 1 or 2 wherein the (b) layer is spectrally sensitized by a dye having the formula:

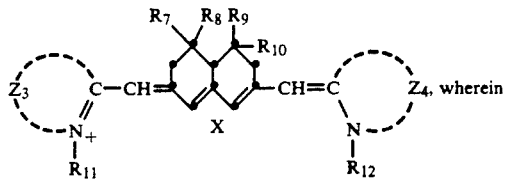

$Z_3$ and $Z_4$ each independently represents the atoms necessary to complete a substituted or unsubstituted 5- or 6-membered heterocyclic ring, $R_7$, $R_8$, $R_9$, and $R_{10}$ each independently represents hydrogen, substituted or unsubstituted alkyl, or substituted or unsubstituted aryl, $R_{11}$ and $R_{12}$ each independently represents substituted or unsubstituted alkyl or substituted or unsubstituted aryl, and X represents a counterion.

15. A photographic element according to claim 14 wherein $R_3$, $R_4$, $R_5$, $R_6$, $R_7$, $R_8$, $R_9$, and $R_{10}$ are hydrogen or methyl.

16. A photographic element according to claim 15, further comprising (c) a third silver halide emulsion layer, which is an infrared-sensitive layer.

17. A photographic element according to claim 14 wherein the (a) layer has its maximum sensitivity between about 730 nm and 790 nm, the (b) layer has its maximum sensitivity between about 790 nm and 850 nm, at least one of $Z_1$ and $Z_2$ represents the atoms necessary to complete a substituted or unsubstituted: oxazole nucleus or thiazoline nucleus, and at least one of $Z_3$ and $Z_4$ represents the atoms necessary to complete a substituted or unsubstituted: thiazole nucleus, selenazole nucleus, quinoline nucleus, tellurazole nucleus, or pyridine nucleus.

18. A photographic element according to claim 17, further comprising (c) a third silver halide emulsion layer, which is an infrared-sensitive layer having a maximum sensitivity between about 850 nm and 900 nm.

19. A photographic element according to claim 14, further comprising (c) a third silver halide emulsion layer, which is an infrared-sensitive layer.

* * * * *